US006289900B1

(12) United States Patent
Kay

(10) Patent No.: US 6,289,900 B1
(45) Date of Patent: Sep. 18, 2001

(54) NAIL WHIRLPOOL BATH

(76) Inventor: Neil J. Kay, 16 Harbor Sight Dr., Rolling Hills Estates, CA (US) 90274

( * ) Notice: Subject to any disclaimer, the term of this patent is extended or adjusted under 35 U.S.C. 154(b) by 0 days.

(21) Appl. No.: 09/617,015

(22) Filed: Jul. 14, 2000

(51) Int. Cl.[7] ..... A45D 29/18
(52) U.S. Cl. ..... 132/74.5; 601/166
(58) Field of Search ..... 132/74.5, 73.6, 132/75.8, 75, 73.5, 73; 601/157, 166, 167; 4/541.1, 541.3, 541.6, 492, 619; 607/85, 86, 87

(56) References Cited

U.S. PATENT DOCUMENTS 4,307,738 * 12/1981 Barns ..... 132/74.5
5,007,441 * 4/1991 Goldstein ..... 132/73.6
5,207,729 * 5/1993 Hatanaka ..... 4/492
5,729,841 * 3/1998 Chan ..... 4/622
5,947,131 * 9/1999 Kim ..... 132/200
6,016,812 * 1/2000 Guynn ..... 132/74.5

FOREIGN PATENT DOCUMENTS

2263722 * 10/1975 (FR) ..... 132/73.6

* cited by examiner

*Primary Examiner*—Todd E. Manahan
*Assistant Examiner*—David Comstock
(74) *Attorney, Agent, or Firm*—Irving Keschner

(57) ABSTRACT

A cosmetology nail whirlpool bath, or spa, wherein the user's nails are exposed to a continuous flow of circulating solution allowing for both a more rapid softening of the nail cuticles and also providing the client with a pleasant sensation as the solution flow circulates between the fingers. The nail bath comprises a first compartment for holding the solution and a second compartment, below the first, for housing a motor, a first gear mounted to the motor shaft and a second gear coupled to the first gear and driving a stirrer device. With the motor energized, the second gear rotates the stirrer which, in turn, creates a whirlpool which circulates the solution within the second compartment.

4 Claims, 1 Drawing Sheet

FIG. 1
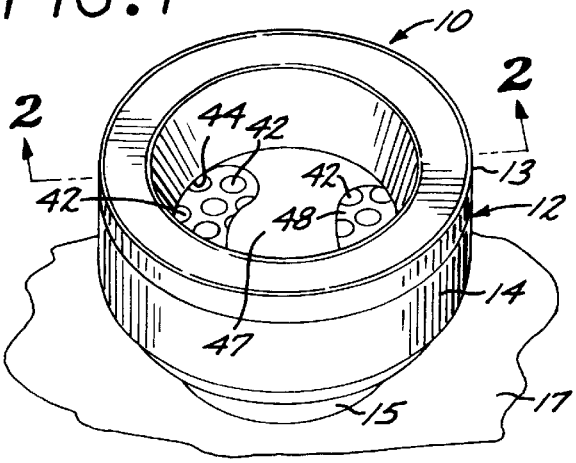
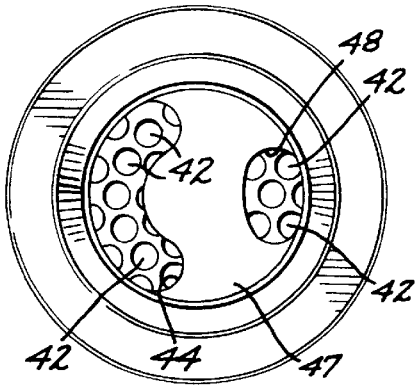
FIG. 3
FIG. 2
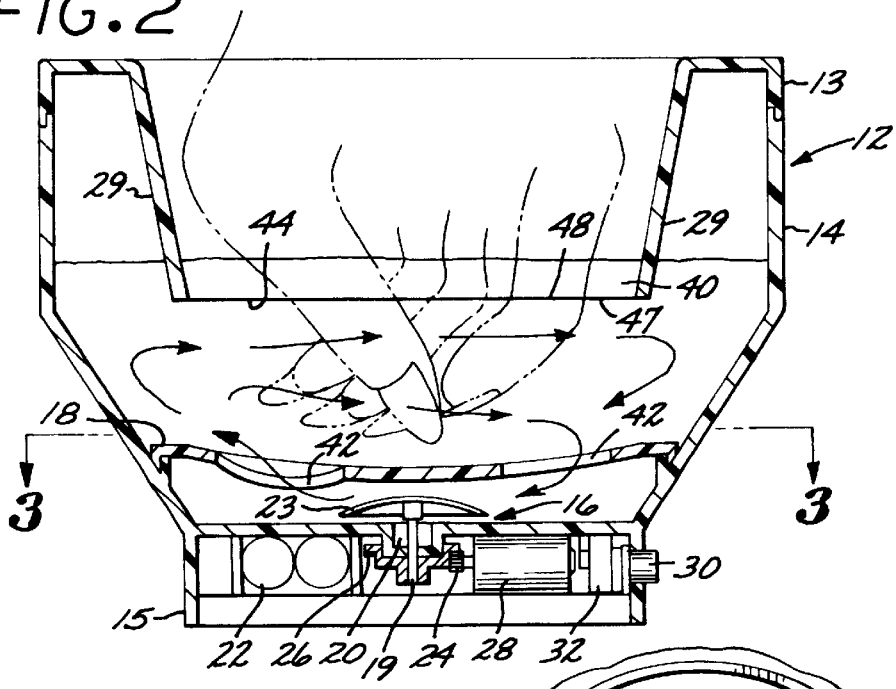
FIG. 4
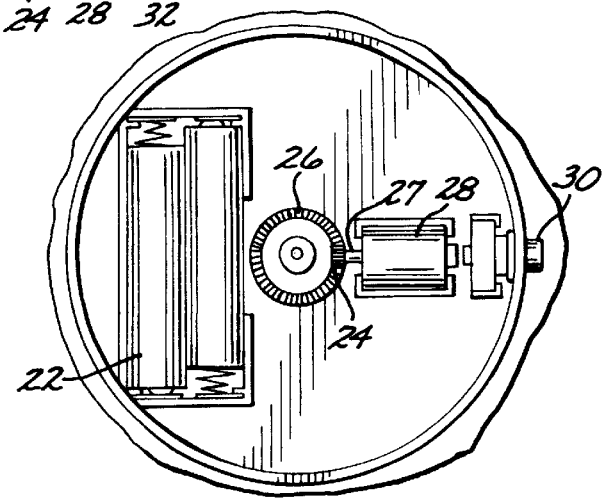

NAIL WHIRLPOOL BATH

BACKGROUND OF THE INVENTION

1. Field of the Invention

The present invention provides a container having a solution therein for receiving a person's fingernails, the solution being stirred into a whirlpool in order to soften the finger cuticles for subsequent treatment.

2. Description of the Prior Art

Beauty salons typically offer manicures and pedicures in addition to the other services offered, such as hair styling.

In preparation for a manicure, the client typically places her/his hand into a bowl of hot solution for soaking in order to soften the nail cuticle to enable the cuticle to be removed. The solution is typically motionless, other than flow patterns caused by the user's fingers.

What is desired is to provide a nail bath which has a circulating bath solution in order to relax the user and to circulate away foreign objects present in the solution away from the user's finger.

SUMMARY OF THE PRESENT INVENTION

The present invention provides a cosmetology nail bath wherein the user's nails are exposed to a continuous flow of circulating solution forming a whirlpool effect allowing for both a more rapid softening of the nail cuticles and also providing the client with a pleasant, relaxing sensation as the solution flow circulates between the fingers and also removing foreign objects present in the solution away from the user's fingers.

The nail bath comprises a first compartment for holding the solution and a second compartment, below the first, for housing a motor, a first gear mounted to the motor shaft and a second gear coupled to the first gear and driving a stirrer device. With the motor energized, the second gear rotates the stirrer which, in turn, rotates, or circulates the solution.

DESCRIPTION OF THE DRAWING

For better understanding of the present invention as well as other objects and further features thereof, reference is made to the following description which is to be read in conjunction with the accompanying drawing therein.

FIG. 1 is a perspective view of the nail bath of the present invention;

FIG. 2 is a cross-sectional view along line 2—2 of FIG. 1;

FIG. 3 is a cross-sectional view along line 3—3 of FIG. 1; and

FIG. 4 is a bottom view of the nail bath shown in FIG. 1.

DESCRIPTION OF THE INVENTION

Referring now to FIGS. 1–4, a portable, cosmetology nail bath 10 in accordance with the teachings of the present invention is illustated.

Bath 10 comprises a container 12 having removable upper case portion 13, bottom case portion 14, base 15, mixing propeller, or stirrer 16, solution, or water, cover 18, gasket ring 20, battery cell 22, gears 24 and 26, motor 28, angled tip portions 29, switch 30 and switch case 32. Base 15 is shown positioned on a surface 17 conveniently located near the user.

The operation of bath 10 is as follows:

The operator puts a conventional cuticle softener solution into the container 12. The user places his/her fingers into container 12 within an area designated by reference numeral 40. Battery cell 22, motor 28 and gears 24 and 26 are positioned in a liquid tight area formed within base member 14. Stirrer 16 comprises a rotatable head portion 23 and rod portion 19. Rod portion 19 is attached to gear 26, gear 26 in turn being operatively coupled to gear 24. Gear 24 is mounted to the output drive shaft of motor 28. Cover 18 is secured within container 12 above stirrer head portion 17 as illustrated and has a plurality of holes 42 formed therein, holes 42 allowing the solution to circulate and pass therethrough. A plate member 47 formed at the bottom of tip portions 29 has cutout portions 44 and 48 located therein, enabling a user to grip bath 10 and move it to a different location when necessary. It should be noted that cutout portions 44 and 48 can have shapes other than that shown in the figures.

After the user places his/her fingers in container 12, switch 30 is activated, turning on motor 28, causing output shaft 27 and the attached gear 24 to rotate. The coupling of gears 24 and 26 cause gear 26 to rotate which, in turn, causes stirrer 16 to rotate. The liquid solution is then rotated to a whirlpool and circulated, past the user's cuticles in the path illustrated by the arrows.

Although only one bath, or spa, for one hand is illustrated, the present invention can be adapted to receive two hands by increasing the spa area.

The present invention thus provides a portable nail bath which circulates the softener solution to soften the user's cuticles in a relaxing and pleasant manner.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A portable nail whirlpool bath positioned at a first location for softening the finger cuticles of a user comprising:

a housing containing a solution, said housing having a top covering with a single opening sized to enable only the hand of a user to be inserted therein;

a stirrer member positioned within said housing;

a compartment positioned within said housing;

a motor positioned within said compartment, said motor having an output shaft; and gearing means coupled between said motor output shaft and said stirrer, energization of said motor causing said stirrer to rotate, the rotation of said stirrer causing said solution to circulate within said housing in a whirlpool effect to soften the finger cuticles of said user.

2. The nail whirlpool bath of claim 1 further including a protective cover member interposed in said housing adjacent said stirrer member such that, in use, it is disposed below the user's fingertips.

3. The nail whirlpool bath of claim 2 wherein said cover member has a plurality of openings allowing the rotated solution to recirculate within said housing.

4. The nail whirlpool bath of claim 2 wherein said compartment stirrer member extends above said compartment and below said protective cover.

* * * * *